US010615487B2

(12) United States Patent
Chou

(10) Patent No.: US 10,615,487 B2
(45) Date of Patent: Apr. 7, 2020

(54) ANTENNA WAVEGUIDE AND ANTENNA MODULE THEREOF

(71) Applicant: Wistron Corporation, New Taipei (TW)

(72) Inventor: Chen-Yu Chou, New Taipei (TW)

(73) Assignee: Wistron Corporation, New Taipei (TW)

( * ) Notice: Subject to any disclaimer, the term of this patent is extended or adjusted under 35 U.S.C. 154(b) by 16 days.

(21) Appl. No.: 16/112,778

(22) Filed: Aug. 27, 2018

(65) Prior Publication Data

US 2020/0014096 A1 Jan. 9, 2020

(30) Foreign Application Priority Data

Jul. 3, 2018 (TW) ..... 107122938 A

(51) Int. Cl.

| | |
|---|---|
| ***H01Q 1/24*** | (2006.01) |
| ***H01Q 21/00*** | (2006.01) |
| ***H01Q 9/04*** | (2006.01) |
| ***H01Q 13/08*** | (2006.01) |

(52) U.S. Cl.

CPC ..... *H01Q 1/246* (2013.01); *H01Q 9/0478* (2013.01); *H01Q 13/08* (2013.01); *H01Q 21/0025* (2013.01)

(58) Field of Classification Search

CPC .. H01Q 1/246; H01Q 21/0025; H01Q 9/0478; H01Q 13/08; H01Q 5/55; H01Q 9/28

See application file for complete search history.

(56) References Cited

U.S. PATENT DOCUMENTS

| | | | | |
|---|---|---|---|---|
| 2,316,151 A * | 4/1943 | Barrow | ..... | H01Q 13/02 343/786 |
| 2017/0309993 A1* | 10/2017 | Tu | ..... | H01Q 1/243 |
| 2018/0175506 A1* | 6/2018 | Park | ..... | H01Q 13/02 |

FOREIGN PATENT DOCUMENTS

TW 201739234 A 11/2017

* cited by examiner

*Primary Examiner* — Hai V Tran
*Assistant Examiner* — Michael M Bouizza
(74) *Attorney, Agent, or Firm* — Winston Hsu

(57) ABSTRACT

A antenna waveguide for an antenna module includes a first surface formed in a first plane, a second plane adjacent to the first plane, a third plane adjacent to the second surface, not adjacent to the first surface, and parallel to the first surface, and a fourth surface adjacent to the first surface and the third surface, and not adjacent to the second surface. The antenna module includes an antenna, wherein a first size of the first surface along a direction of the antenna is substantially equal to a third quarter wavelength of a radio-frequency signal of the antenna, the antenna is formed in a second plane, and projections of the second surface and the fourth surface onto a third plane are perpendicular to the first plane and the second plane.

4 Claims, 3 Drawing Sheets

ANTENNA WAVEGUIDE AND ANTENNA MODULE THEREOF

BACKGROUND OF THE INVENTION

1. Field of the Invention

The present invention relates to an antenna waveguide and antenna module thereof, and more particularly, to an antenna waveguide and antenna module thereof capable of increasing antenna directivity.

2. Description of the Prior Art

The signal strength of an RF (Radio-frequency) signal is negatively proportional to the propagating distance for unit wavelength of the RF signal, and the wavelength of the RF signal is negatively proportional to frequency. Therefore, for the RF signal with high frequency and short wavelength (e.g., RF signals with a frequency range 700 MHz~6 GHz), the antenna radiation efficiency shall be increased as much as possible to maximize a signal coverage for the RF signal with high frequency.

In practice, if a propagating target is at a fixed location, it is common to make a radiating pattern of a directional antenna with higher antenna efficiency or higher directivity toward the propagating target to ensure the communication quality along a pointing direction of the directional antenna. On the other hand, if the propagating target is at arbitrary locations, it may use multiple antennas to receive and transmit RF signals, to ensure communication quality along multiple directions. Therefore, how to improve the antenna efficiency to ensure the communication quality is a topic in the industry.

SUMMARY OF THE INVENTION

It is therefore an objective of the present invention to provide an antenna waveguide and antenna module thereof for increasing antenna directivity to improve antenna efficiency along a pointing direction.

The present invention discloses an antenna waveguide for an antenna module includes a first surface formed in a first plane, a second plane adjacent to the first plane, a third plane adjacent to the second surface, not adjacent to the first surface, and parallel to the first surface, and a fourth surface adjacent to the first surface and the third surface, and not adjacent to the second surface. The antenna module includes an antenna, wherein a first size of the first surface along a pointing direction of the antenna is substantially equal to a third quarter wavelength of a radio-frequency signal of the antenna, the antenna is formed in a second plane, and projections of the second surface and the fourth surface onto a third plane are perpendicular to the first plane and the second plane.

The present invention further discloses an antenna module for wireless communication device including at least one antenna and at least one antenna waveguide. One of the at least one antenna waveguide respectively connects to one of the at least one antenna, and includes a first surface formed in a first plane, a second plane adjacent to the first plane, a third plane adjacent to the second surface, not adjacent to the first surface, and parallel to the first surface, and a fourth surface adjacent to the first surface and the third surface, and not adjacent to the second surface. The antenna module includes an antenna, wherein a first size of the first surface along a pointing direction of the antenna is substantially equal to a third quarter wavelength of a radio-frequency signal of the antenna, the antenna is formed in a second plane, and projections of the second surface and the fourth surface onto a third plane are perpendicular to the first plane and the second plane.

The present invention uses the antenna waveguide to guide the radiating electromagnetic wave of the antenna to make it concentrated. The size of the antenna waveguide along the pointing direction of the antenna is designed to be a third quarter wavelength of the RF signal, to improve the antenna efficiency and transmission capability along the pointing direction of the antenna. In addition, by adjusting the opening angle of the antenna waveguide and configurations of the multiple antennas in the antenna module, the signal coverage of the antenna module may be enlarged.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
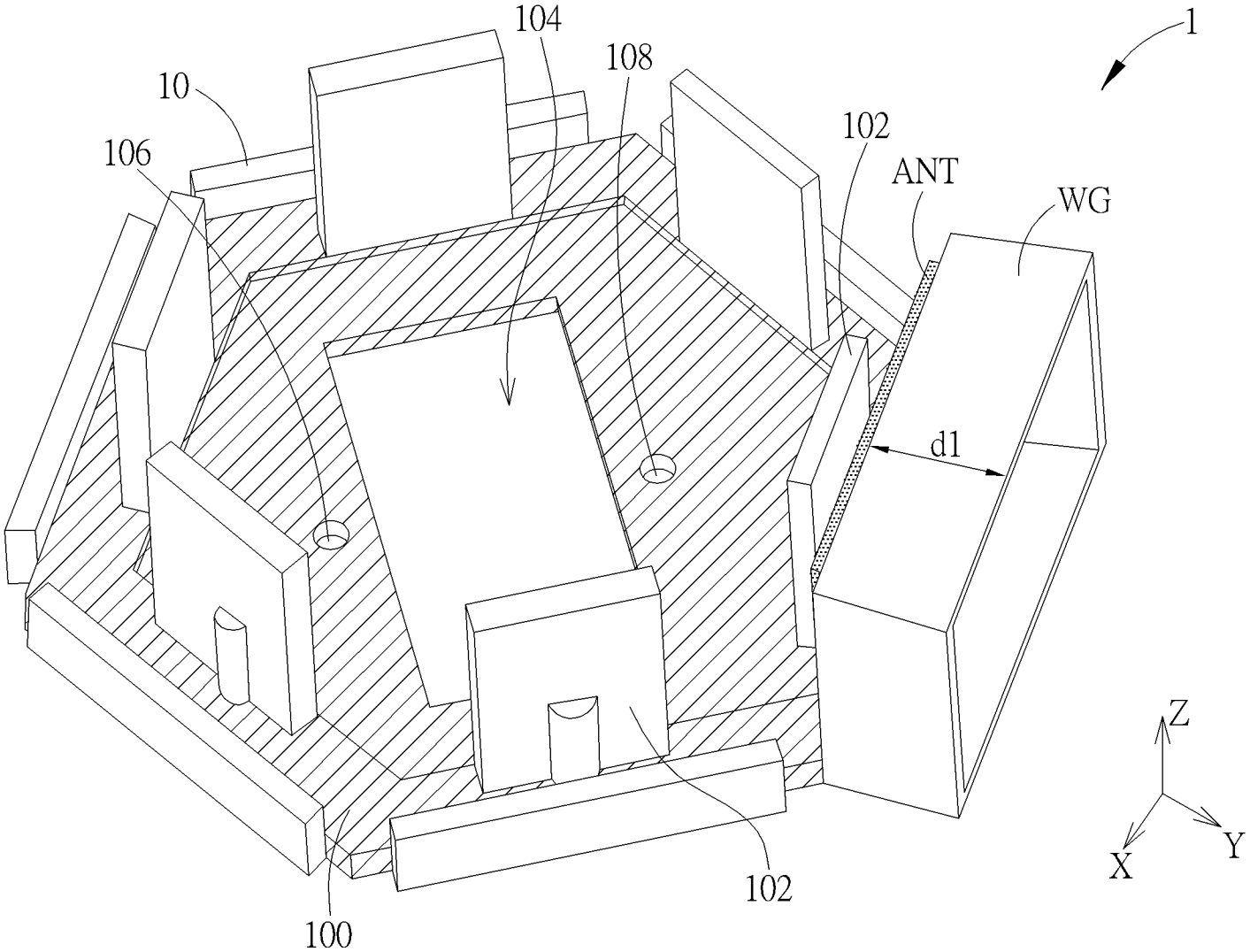
FIG. 1 is a schematic diagram of an antenna module according to an embodiment of the present invention.

FIG. 1 is a schematic diagram of an antenna module 1 according to an embodiment of the present invention. The antenna module 1 may be used in a wireless communication device, such as a wireless data collector, a wireless access point (AP), and so on. The antenna module 1 includes a holder 10, at least one antenna waveguide WG and at least one antenna ANT.

The antenna ANT is used for transmitting and receiving RF (radio-frequency) signals, such as millimeter wave with operating frequency from 20 GHz to 60 GHz. The antenna waveguide WG is coupled to the antenna ANT, made of metal materials, and used for guiding a radiation pattern of the antenna ANT toward a pointing direction to make it concentrated. For example, an amount of the RF signals of the antenna ANT may propagate along the pointing direction to improve the antenna efficiency and transmission capability along the pointing direction.

In one embodiment, the antenna ANT is formed in a second plane (e.g., XZ plane), the pointing direction of the antenna ANT is along a Y direction, and a first size d1 of the antenna waveguide WG along the pointing direction is a third quarter (¾) wavelength of the RF signal, wherein the direction Y is perpendicular to the XZ plane. In such a structure, the antenna waveguide WG may effectively guide the radiating electromagnetic wave of the antenna ANT to make it concentrated, to improve antenna efficiency and transmission capability along the pointing direction of the antenna.

The holder 10 includes abase 100, at least one rib 102, wherein a window 104 and holes 106 and 108 are formed in the base 100. The base 100 is formed in a first plane (e.g., XY plane), the rib 102 connects with the base 100 and extends toward a Z direction from the base 100. The base 100 is used for holding the antenna ANT and the antenna waveguide WG, and the antenna ANT may be attached to the rib 102, for example, by screws, glues, hooks, and the like, to be fixed to the base 100.

In this embodiment, when the base 100 is formed in the XY plane and needs to hold the multiple antennas ANT, the ribs 102 may be respectively disposed around a center of the base 100 with equal angles apart, and the multiple antennas ANT may be disposed equally apart on the base 100 accordingly. For example, six ribs 102 may be respectively disposed with 60 degrees apart to dispose six antennas ANT on the base 100, so as to ensure that communication quality is uniform along every direction. In other embodiments, there may be 24, 12, 8, 4 or 2 of the antennas ANT respectively disposed with 15, 30, 45, 90 or 180 degrees apart on the holder 10.

During production line assembling, an operator may firstly assemble the antenna ANT with the antenna waveguide WG (e.g., screws, glues, hooks, and the like), install the antenna ANT assembled with the antenna waveguide WG to the holder 10, and connects a transmission line (not shown in FIG. 1) of the antenna ANT through the window 104 to an RF signal processing module, which is not limited. In addition, the operator may insert ribs of mechanical parts or a housing of the wireless communication device (not shown in FIG. 1) into the holes 106 and 108 for positioning and alignment, which improves reliability for assembling.

Therefore, under the structure of the antenna module 1, the antenna waveguide WG may guide the radiating electromagnetic wave of the antenna ANT to make it concentrated to improve antenna efficiency and transmission capability along the pointing direction. Those skilled in the art may make modifications and alterations accordingly, which is not limited to the embodiments of the present invention.

Figure 2:
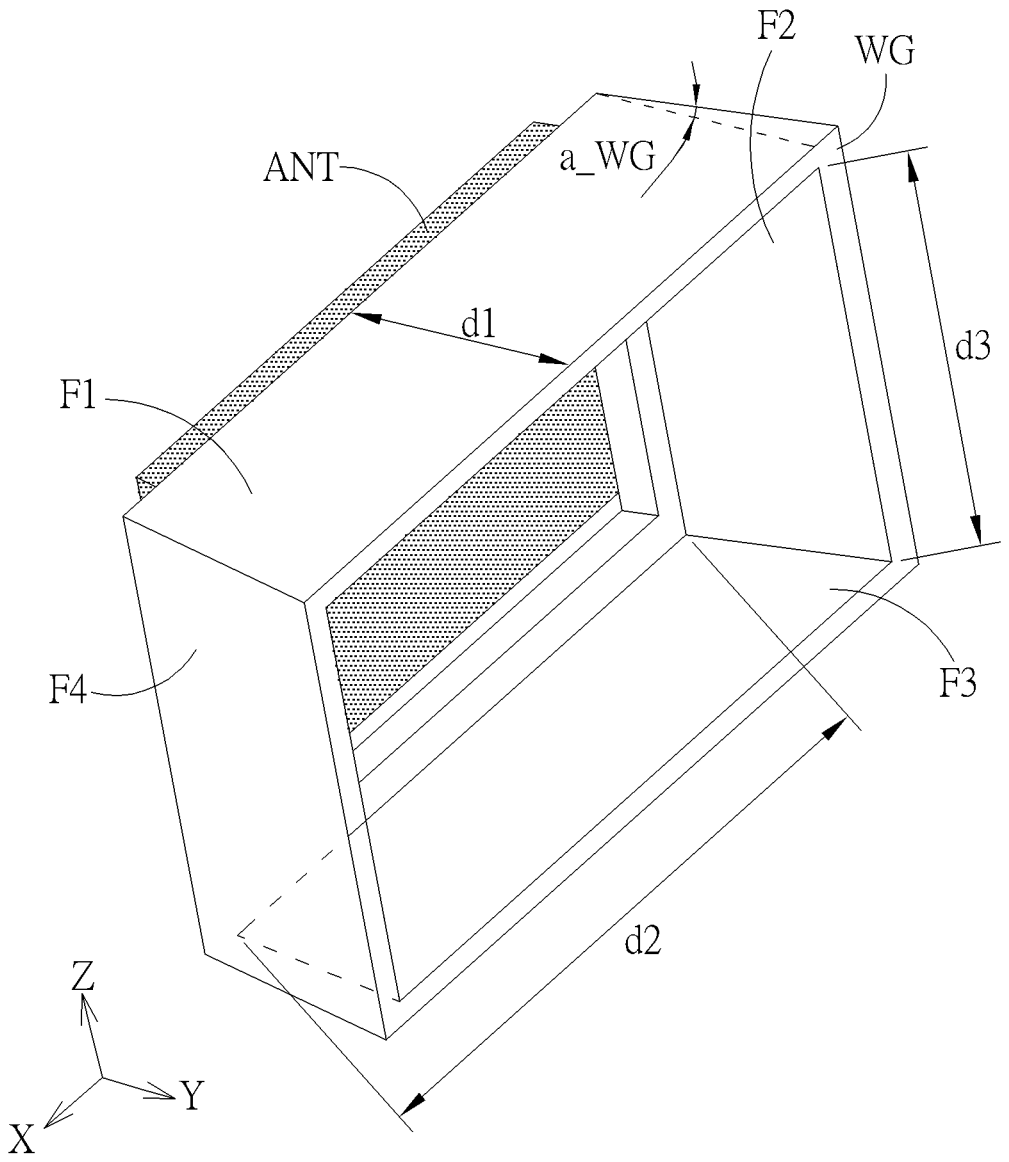
FIG. 2 is a schematic diagram of an antenna waveguide and an antenna according an embodiment of the present invention.

FIG. 2 is a schematic diagram of the antenna waveguide WG and the antenna ANT according an embodiment of the present invention. In this embodiment, the antenna ANT is formed in a printed circuit board (PCB), the printed circuit board presents a rectangular, and the antenna waveguide WG includes a first surface F1, a second surface F2, a third surface F3 and a fourth surface F4, which is not limited. In one embodiment, the first size d1 of the antenna waveguide WG along the pointing direction Y of the antenna ANT is a third quarter wavelength of the RF signal, a second size d2 of the antenna waveguide WG along the X direction is a size of the printed circuit board along the X direction, and a third size d3 of the antenna waveguide WG along the Z direction is a size of the printed circuit board along the Z direction, which is not limited.

The first surface F1 is formed in the first plane XY, adjacent to the second surface F2 and the fourth surface F4, the first surface F1 is not adjacent to the third surface F3, the second surface F2 is adjacent to the first surface F1 and the third surface F3, the second surface F2 is not adjacent to the fourth surface F4, and the first surface F1 is parallel to the third surface F3. The antenna ANT is formed in the second plane XZ, projections of the second surface F2 and the fourth surface F4 onto a third plane YZ are perpendicular to the first plane XY and the second plane XZ.

In the embodiment of FIG. 1, when the base 100 is formed in the XY plane and needs to hold the multiple antenna ANT, the first surface F1 and the third surface F3 present a trapezoid, wherein a bevel angle a_WG of the trapezoid (or an angle between the second surface F2 and the YZ plane) is substantially from 5 to 15 degrees. The second surface F2 and the fourth surface F4 present a rectangular, which is not limited.

In other embodiments, when the base 100 is formed in a curved surface or a spherical surface and needs to hold the multiple antennas ANT, the bevel angle a_WG of the trapezoid (or the angle between the second surface F2 and the YZ plane) is substantially from 15 to 45 degrees. Under a condition that a radius of the base 100 is given, an area of the curved surface or spherical surface is greater than an area of a plane, which means that a signal coverage of the antenna module 1 increases. Therefore, an opening range of the antenna waveguide WG should be greater (i.e., the greater bevel angle a_WG, the greater opening range) to enlarge the signal coverage. In addition, a number of the multiple antennas ANT may be increased based on practical requirements, and accordingly select the proper bevel angle a_WG to meet requirements for the antenna directivity and the signal coverage.

Figure 3:
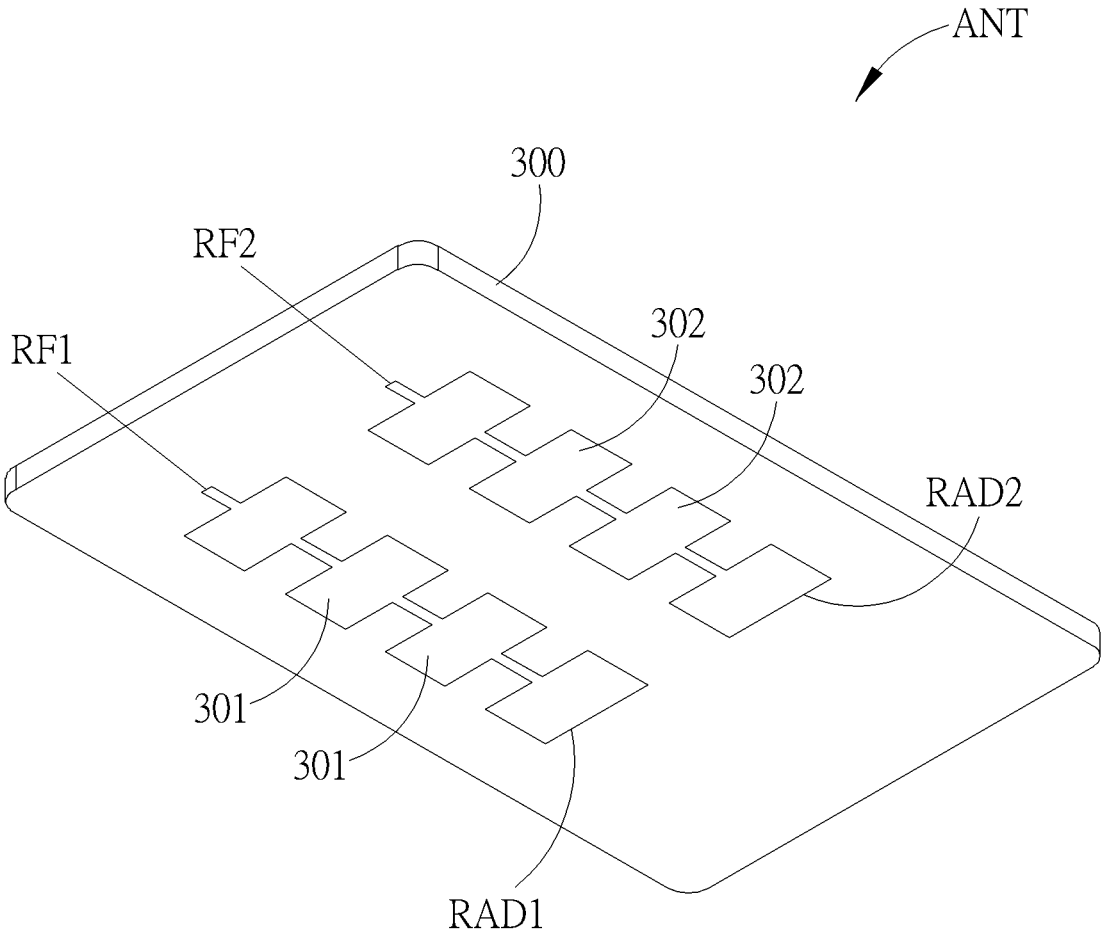
FIG. 3 is a schematic diagram of an antenna according to an embodiment of the present invention.

FIG. 3 is a schematic diagram of the antenna ANT according to an embodiment of the present invention. The antenna ANT is formed in a substrate 300 (e.g., printed circuit board), and includes a first radiator RAD1 and a second radiator RAD2. The first radiator RAD includes multiple first collinear elements 301 for radiating a first RF signal RF1; and the second radiator RAD2 includes multiple second collinear elements 302 for radiating a second RF signal RF2.

In this embodiment, the first radiator RAD1 and the second radiator RAD2 may be an end-fed collinear antenna, which is not limited. Due to the characteristics of high directivity (or high gain) of the collinear antenna, using the antenna waveguide WG to guide to the pointing direction of the collinear antenna and properly arranging configurations of the multiple collinear antennas, the antenna efficiency and signal coverage may be improved and enlarged to ensure the communication quality for multiple pointing directions of the multiple collinear antennas.

In practice, when the antenna module 1 is utilized in a wireless data collector of a baby nursing center, since each baby cot is equipped with a vital sign monitor, a designer may arrange the pointing directions of multiple antennas based on locations of the baby cots in the baby nursing center, so as to ensure data collection from the vital sign monitors.

To sum up, the present invention uses the antenna waveguide to guide the radiating electromagnetic wave of the antenna to make it concentrated. The size of the antenna waveguide along the pointing direction of the antenna is designed to be a third quarter wavelength of the RF signal, to improve the antenna efficiency and transmission capability along the pointing direction of the antenna. In addition, by adjusting the opening angle of the antenna waveguide and configurations of the multiple antennas in the antenna module, the signal coverage of the antenna module may be enlarged.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna module for a wireless communication device, comprising:

at least one antenna; and at least one antenna waveguide, wherein one of the at least one antenna waveguide respectively connects to one of the at least one the antenna, and comprises:

a first surface formed in a first plane;

a second surface adjacent to the first surface;

a third surface adjacent to the second surface, not adjacent to the first surface, and parallel to the first surface;

a fourth surface adjacent to the first surface and the third surface, and not adjacent to the second surface; and a holder comprising:

a base formed in the first plane for holding the at least one antenna and the at least one antenna waveguide, wherein a window and multiple holes are formed in the base; and at least one rib connected to the base and extending toward a second direction from the base, wherein one of the at least one rib respectively connects to one of the at least one antenna;

wherein a first size of the first surface along a pointing direction of the antenna module is substantially equal to a third quarter wavelength of a radio-frequency signal of the antenna, the antenna is formed in a second plane, and projections of the second surface and the fourth surface onto a third plane are perpendicular to the first plane and the second plane;

wherein the at least one antenna comprises multiple antennas, the at least one antenna waveguide comprises multiple antenna waveguides, and the at least one rib comprises multiple ribs, the multiple ribs are respectively disposed around a center of the base with isometric angles to respectively dispose the multiple antennas and the multiple antenna waveguides on the base.

2. The antenna module of claim 1, wherein the first surface and the third surface present a trapezoid, and the second surface and the fourth surface present a rectangular, and an angle between the second surface and the third plane is substantially range from 5 to 45 degrees.

3. The antenna module of claim 1, wherein the at least one antenna is an end-fed collinear antenna.

4. The antenna module of claim 1, wherein the antenna is formed in a substrate, a size of the substrate along a first direction is a second size of the first plane, the size of the substrate along a second direction is a third size of the second plane, and the pointing direction is perpendicular to the first direction and the second direction.

* * * * *